United States Patent [19]

MacDonald, Jr.

[11] 4,332,547

[45] Jun. 1, 1982

[54] THRUST AUGMENTER EJECTOR COMBUSTION DEVICE

[76] Inventor: James D. MacDonald, Jr., 4043 Harvest Hill, Apt. 2163, Dallas, Tex. 75234

[21] Appl. No.: 80,985

[22] Filed: Oct. 1, 1979

[51] Int. Cl.[3] ..... F23D 11/44

[52] U.S. Cl. ..... 431/242; 431/247; 431/285; 431/329; 431/354; 239/DIG. 7; 244/31

[58] Field of Search ..... 431/11, 242, 243, 247, 431/326, 328, 329, 346, 158, 284, 285, 354; 239/DIG. 7, 424; 417/196, 197; 244/30, 31, 97, 98, 32

[56] References Cited

U.S. PATENT DOCUMENTS

| | | | |
|---|---|---|---|
| 1,278,577 | 6/1972 | Desty et al. | 431/354 |
| 2,777,508 | 1/1957 | Jurisich | 431/284 |
| 2,983,312 | 5/1961 | Finley et al. | 431/248 |
| 3,096,048 | 7/1963 | Yost | 244/97 |
| 3,670,993 | 6/1972 | Kay et al. | 431/248 |
| 3,695,820 | 10/1972 | Hawkes et al. | 431/354 |
| 4,033,714 | 7/1977 | Longworth | 431/354 |

FOREIGN PATENT DOCUMENTS

| | | | |
|---|---|---|---|
| 518639 | 11/1955 | Canada | 431/285 |
| 1421765 | 1/1976 | United Kingdom | 431/247 |

OTHER PUBLICATIONS

J. A. C. Kentfield, "Prediction of Performance of Low-Pressure-Ratio Thrust-Augmenter Ejectors", *J. Aircraft,* vol. 15, No. 12, Dec. 1978, pp. 849–856.

M. R. Seiler and E. F. Schum, "An Analytical and Experimental Investigation of Diffusers for VSTOL Thrust Augmenting Ejectors", *AIAA Aircraft Systems and Technology Conference,* Los Angeles, Calif., Aug. 21–23, 1978.

P. M. Bevilaqua and A. D. DeJoode, "Viscid/Inviscid Interaction Analysis of Thrust Augmenting Ejectors", Report for Office Naval Research, ONR Task, 212–249, Feb. 28, 1978.

*Primary Examiner*—Samuel Scott
*Assistant Examiner*—Lee E. Barrett
*Attorney, Agent, or Firm*—Robert G. Mentag

[57] ABSTRACT

A combustion device for use with pressurized and zero pressure hot air balloons or other hot air appliances, which comprises in general, a coanda-type inlet nozzle, a diffuser, a flame-arrestor screen, and a fuel preheater means for supplying required fuel vapor at a desired pressure to the inlet nozzle. The combustion device may be used with any suitable fuel, but it is primarily applicable to propane. The combustion device is a fuel pressure driven-nozzle-mixer-diffuser-arrestor screen burner combustion device which generates a stream of heated air for the transfer of thermal energy to a load.

5 Claims, 4 Drawing Figures

THRUST AUGMENTER EJECTOR COMBUSTION DEVICE

BACKGROUND OF THE INVENTION

1. Field of the Invention

This invention relates to combustion devices for hot air appliances, and more particularly, to a novel and improved combustion device for use with pressurized and zero-pressure hot air appliances. The invention is specifically concerned with a propane-air combustion device of the open-cycle external combustion, continuous-process type, which may be described as a fuel pressure driven nozzle mixer-diffuser-screen burner combustion device which generates a stream of heated air for the transfer of thermal energy to a load.

2. Description of the Prior Art

It is well known in the combustion device art to provide burners for hot air appliances. A disadvantage of such prior art combustion device is that they provide a fuel rich flame, and they are unable to entrain a sufficient amount of air to provide complete combustion and a clear air flame, as well as a low temperature flame. Examples of such prior art combustion devices for balloons are illustrated in U.S. Pat. Nos. 4,008,041 and 4,076,188. Other pertinent references are shown in U.S. Pat. Nos. 3,420,473, 3,833,338, 3,840,321 and 4,018,406. A further prior art reference is an article appearing in the "J. Aircraft" magazine, Vol. 15, No. 12, December 1978, which is entitled "Prediction of Performance of Low-Pressure-Ratio Thrust-Augmenter Ejectors", by J. A. C. Kentfield, University of Calgary, Alberta, Canada. Another prior art reference is an article by M. R. Seiler and E. F. Schum (Rockwell International, Columbus, Ohio) entitled "An Analytical and Experimental Investigation of Diffusers for VSTOL Thrust Augmenting Ejectors" which was presented at the AIAA Aircraft Systems and Technology Conference, Los Angeles, Calif., on Aug. 21–23, 1978. A copy of this article may be obtained from the American Institute of Aeronautics and Astronautics, 1290 Avenue of the Americas, New York, N.Y. 10019.

Still another prior art reference is an article by P. M. Bevilaqua and A. D. DeJoode of Rockwell International, Columbus Aircraft Division, Columbus, Ohio 43216, entitled "Viscid/Inviscid Interaction Analysis of Thrust Augmenting Ejectors", dated Feb. 28, 1978.

The inlet nozzle-diffuser structures in the last three mentioned articles are presented as having an optimum configuration thrust augmentation. However, a disadvantage of such inlet nozzle-diffuser structures is that they do not produce the highest entrainment ratio. The low velocity air-fuel mixture exiting the center section of the flame retention screen allows the screen to reach a high temperature and further slow the air-fuel mixture flow at center. The result is to greatly impede the inlet nozzle-diffuser performance.

SUMMARY OF THE INVENTION

In accordance with the present invention, the combustion device comprises an inlet nozzle, a diffuser, a flame-arrestor screen and a fuel preheater means. These elements are constructed and arranged to function in a manner to produce a pressurized stream of air at high temperature for use with hot air appliances, such as pressurized and zero-pressure hot air appliances.

The combustion device of the present invention is primarily applicable to propane fuel, however, it may also be used with other fuels. An objective of the present invention is to provide a means for effecting complete combustion of fuel-air mixtures over a wide range of velocities, while maintaining stationary burning which commences at the exterior surface of the flame-arrestor screen.

The combustion device of the present invention improves upon the prior art related devices by entraining a higher ratio of air to primary fuel, as propane, at normal supply pressures of fuel, by excluding burning from the diffuser interior, and by allowing operation over a wide range of output while providing sufficient air for complete combustion of the fuel.

Heat energy supplies the forces necessary to drive the combustion device, both as a means of pressurizing and vaporizing the driving fluid fuel. The driving fluid, gaseous fuel, is expanded in a unique inlet nozzle section by expulsion through a circumferential slot and entraining ratios of air necessary for combustion by boundary-layer blowing of the inlet nozzle wall. A thorough mixing of the fuel and air occurs as the air-fuel mixture is driven through a unique thrust augmenting diffuser and expelled at the flame-arrestor screen, after which the fuel-air mixture is burned exterior of the screen.

The flame-arrestor screen is constructed of thermally conductive material which possesses an optimum surface area, hole size, density, and thickness, all of which provides an exclusion of the flame from the interior of the diffuser, with negligible back pressure. The structure of the flame-arrestor screen limits the interior screen surface temperature to less than that required to produce ignition by the transfer of heat from the exterior surface of the screen to gasses in transit through the screen.

The inlet nozzle is constructed for a throat diameter which will produce a minimum pressure drop while maintaining a total flow with a constant ratio of primary fuel to secondary entrained air. A gap for boundary-layer blowing is placed in the wall of the convergence section of the inlet nozzle. The proportions of the gap differ from known devices in that they are selected so as to compensate for the increased density of the primary fuel, the resultant increased entrainment caused by greater density of driving fuel, and the resulting lower velocities in the inlet nozzle throat.

The diffuser is constructed and arranged to produce a maximum augmentation of inlet nozzle thrust while providing a minimum of back pressure to the inlet nozzle. The diffuser comprises a unique two-section structure. The first section follows the inlet nozzle and diverges uniformly in a cone at an angle to cause maximum amplification of thrust for the density of the exhausted mixture. At this point where this amplification ceases to be effective, the second section diverges conically at a greatly increased angle of as large a magnitude as is consistent with maintaining a tight combustion pattern exiting the flame-arrestor screen.

DESCRIPTION OF THE PREFERRED EMBODIMENT

Figure 1:
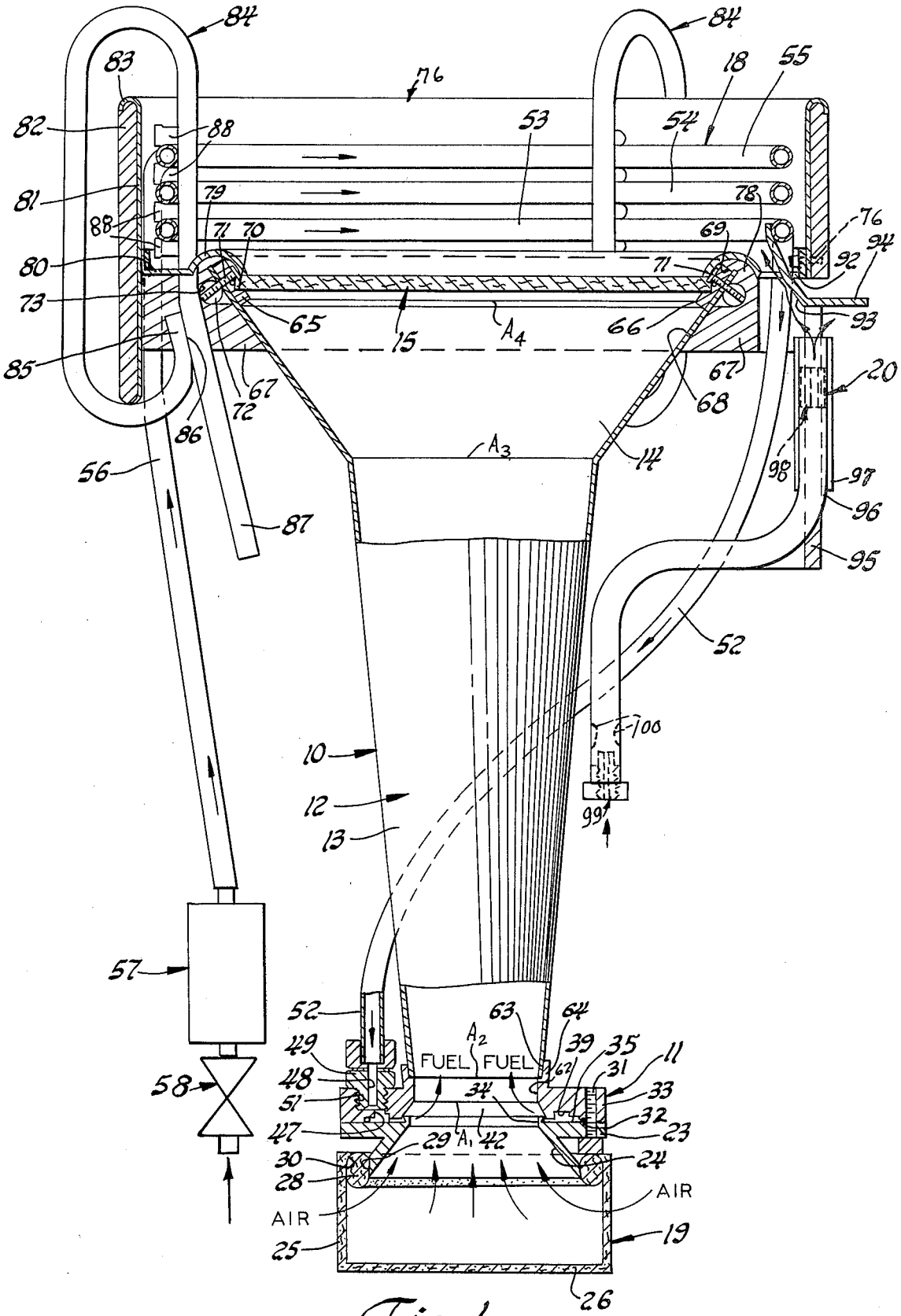
FIG. 1 is an elevational view, with parts broken away and parts in section, of a propane-air combustion device embodying the invention, and which is adapted for use with pressurized and zero-pressure hot air appliances.

Referring now to the drawings, and in particular to FIG. 1, the numeral 10 generally designates a combustion device made in accordance with the principles of the present invention. The numeral 11 generally designates an inlet nozzle. The numeral 12 generally designates a diffuser which has its entrance end operatively attached to the inlet nozzle. The diffuser 12 is a two-section diffuser comprising a first section 13 which is attached to the inlet nozzle 11, and a second section 14. Operatively mounted on the discharge end of the diffuser second section 14 is a flame-arrestor screen, generally indicated by the numeral 15.

A fuel preheater means, generally indicated by the numeral 18, is operatively mounted at the discharge end of the diffuser second section 14. The numeral 19 generally designates an air filter which is operatively mounted around the intake end of the inlet nozzle 11, and it also functions as a flame arrestor to prevent flashback or pre-ignition. The numeral 20 generally designates a pilot flame means.

Figure 3:
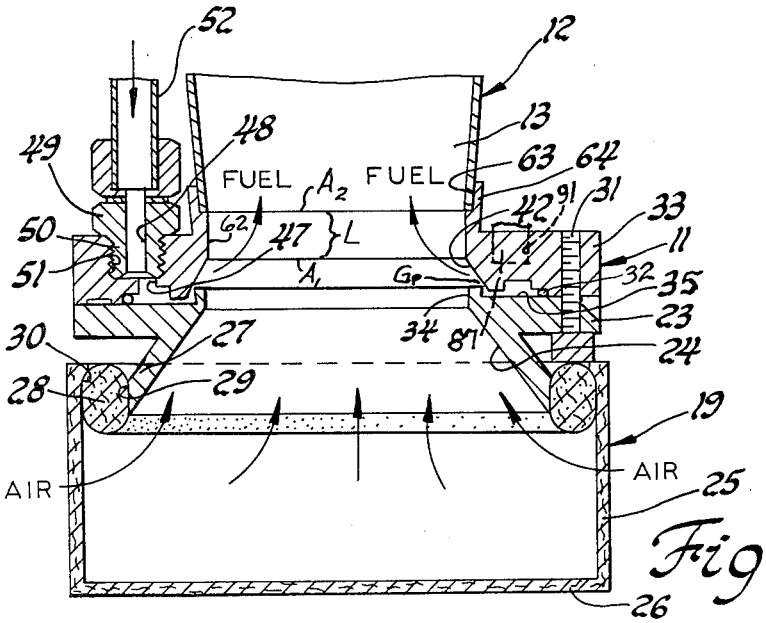
FIG. 3 is a fragmentary, elevational section view of the input or lower end of the combustion illustrated in FIG. 1.

As shown in the enlarged view of FIG. 3, the inlet nozzle 11 includes a first body portion 23 which includes an intake passage 24 which converges inwardly in a conical shape. The intake air filter 19 is mounted around the outer end of the converging intake passageway 24 on the outer end of a conical body extension portion 27. The intake air filter 19 includes an annular body portion 25 and an integral outer end portion 26. The inner end of the filter body portion 25 is open and it is operatively mounted around the outer end of the inlet nozzle body portion 27, and it is secured thereto by a retainer ring member 28. The retainer ring member 28 is resiliently mounted between a peripheral outer face 29 on the free end of the inlet nozzle body portion 27 and an inner curved surface 30 formed on the free end of the filter body 25.

Figure 4:
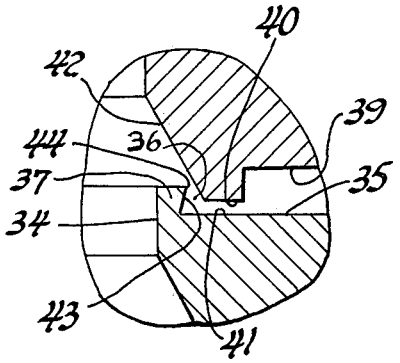
FIG. 4 is a fragmentary, enlarged section view of the nozzle structure illustrated in FIGS. 1 and 3.

As best seen in FIG. 3, the inlet nozzle 11 includes a second body portion 33 which forms the discharge end of the inlet nozzle and which is operatively secured to the first body portion 23 by any suitable means, as by a plurality of suitable machine screws 31. The numeral 34 designates a constant diameter throat which is formed at the exit end of the intake passage 24. A circular fuel feed passageway is formed by the inner face 35 of the inlet nozzle first body portion 23 and a complementary annular groove 39 formed in the adjacent face of the second inlet nozzle body portion 33. As best seen in FIG. 4, the fuel is drawn from the last mentioned annular fuel passageway through a pressure equalization passageway or gap formed between the surfaces 41 and 40 of the inlet nozzle body portions 23 and 33, respectively, immediately inward from the last mentioned annular fuel passageway. The inner end of the pressure equalization gap communicates with an annular chamber 36 which is formed between the outwardly converging annular surface 43 which is formed around a longitudinal, inwardly extended portion 37 of the inlet nozzle first body portion 23. The inlet nozzle body portion 37 forms the inner or discharge end of the throat portion 34 of the first inlet nozzle portion 23. The outer peripheral edge on the first inlet nozzle body portion 37 is indicated by the numeral 44 in FIG. 4, and the lateral space between the peripheral edge 44 and the converging primary nozzle converging portion 42 formed in the second inlet nozzle body portion 33 forms an annular exit gap through which the fuel is exhausted into the diffuser 12.

As shown in FIG. 3, the annular fuel feed passageway formed by the annular groove 39 and the adjacent face 35 of the first fuel inlet nozzle body portion 23 is operatively connected by a passageway or bore 47 to a threaded port 51. Threadably mounted in the port 51 is the threaded end 50 of a suitable tube fitting 49. A passageway 48 is formed through the tube fitting 49 and it communicates at its inner end with the bore 47. Operatively mounted in the tube fitting 49 is one end of a fuel feed tube 52 which is operatively connected to the output end of the fuel preheater means 18.

As best seen in FIG. 1, the fuel feed tubing 52 is operatively connected at its upper end to a series of continuous loops of tubing indicated by the numerals 53, 54 and 55 which are disposed around the outlet end of the diffuser 12, at a point exterior to the flame-arrestor screen 15. The feed tube 53 is connected to tube 54, and tube 54 is connected to tube 55. The inlet end of tube 55 is connected to a feed tube 56 which has its inlet end connected to a suitable conventional fuel filter, generally indicated by the numeral 57. The fuel filter 57 is connected to a suitable fuel supply source through a suitable conduit, and a suitable throttling valve, such as a needle valve, as generally indicated by the numeral 58.

Figure 2:
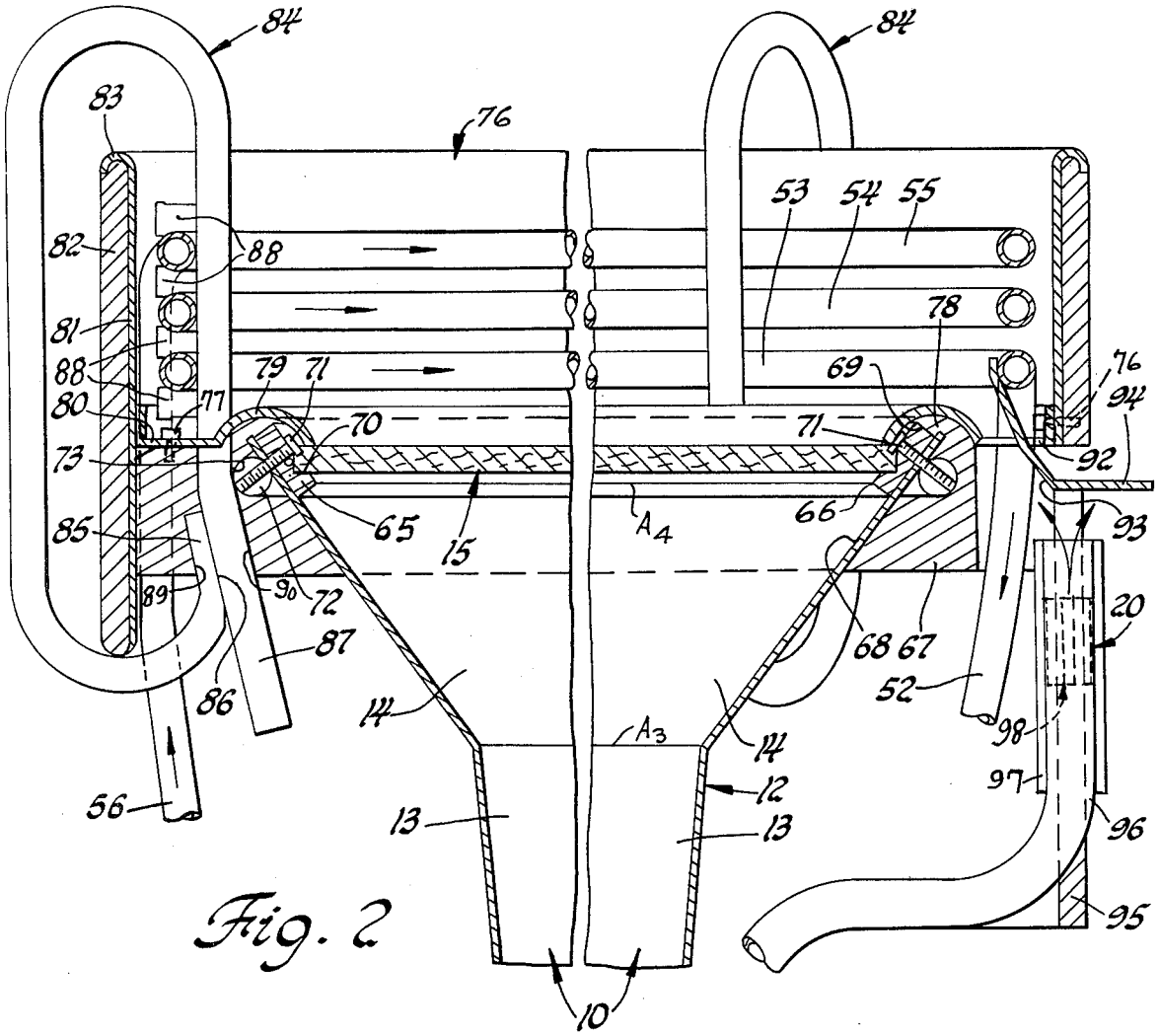
FIG. 2 is an enlarged, broken, longitudinal sectional view of the upper or discharge end of the combustion device illustrated in FIG. 1.

As shown in FIGS. 1, 2 and 3, the first section 13 of the diffuser 12 is a tubular member which converges toward the inlet nozzle 11. The intake end of the diffuser first section B is indicated by the numeral 63, and it is seated in an annular seat that is formed in an integral annular flange 64 on the inlet nozzle body portion 33. The diffuser first section 13 is secured to the flange 64 by any suitable means, as by welding or the like. It will be understood that all of the various parts of the combustion device 10 will be made from conventional suitable materials.

The intake throat of the first diffuser section 13 is indicated in FIGS. 1 and 3 by the letter $A_2$. The exit passage of the inlet nozzle 11 which discharges through the diffuser throat $A_2$ is indicated by the numeral 62, and the entrance end of the passage 62 is indicated by the letter $A_1$. The letters $A_1$ and $A_2$ also stand for a symbol of the cross sectional area at the corresponding parts in the inlet nozzle and diffuser structure, respectively. The length of the air-fuel mixing zone 62 is the distance between $A_1$ and $A_2$, and it is indicated by the letter "L" in FIG. 3. The mix zone 62 is a constant diameter section in the inlet nozzle 11. The length "L" of the mix zone 62 is determined by the ratio of the area $A_3$, which is the area of the inlet throat of the diffuser second section 14, as indicated by the letter $A_3$ in FIGS. 1 and 2. As shown in FIGS. 1 and 2, the discharge throat of the diffuser second section 14 is indicated by the letter $A_4$. The discharge throat $A_4$ is the area within the inner circumferential edge 66 of the flame-arrestor screen retainer ring 65.

As shown in FIGS. 1 and 3, the discharge end of the diffuser second section 14 is supported in an annular, diverging outwardly seat 68 which is formed in an annular mounting bracket 67. The annular mounting bracket 67 has an integral, axially extended flange 78 which has a rounded end surface. An inwardly facing, annular recess or seat 73 is formed in the flange 78 and it communicates with an adjacent inwardly converging annular seat 69. A mounting ring 72, made from any suitable material, is mounted in the annular groove seat 73 and an outer face of the outer end of the diffuser second section 14 rests on said mounting ring 72. The angled retainer ring 65 is seated on the inner surface 68 of the second diffuser section 14, adjacent the discharge end thereof, and the ring corner 66 forms the discharge throat of the diffuser second section 14, as described hereinbefore. The retainer ring 65 has a right angular seat 70 formed peripherally around the inner face thereof for receiving the peripheral edge of the annular flame-arrestor screen 15. The screen 15 is secured to the diffuser second section 14 and to the retainer rings 65 and 72 by a plurality of suitable machine screws 71.

A preheater nozzle, generally indicated by the numeral 76, is operatively mounted on the annular mounting bracket 67. A circular, arcuate support ring 79 is mounted on the curved flange 78 of the bracket 67 and it has integrally attached to the outer periphery thereof a circular flat support plate 80 which is secured by any suitable means, as suitable screws 77 to the bracket 67. The preheater nozzle 76 includes a tubular body 82 which is made from any suitable material and which is covered along the inner tubular face by a liner 81. The upper end of the last mentioned liner 81 is curved around the exit end of the nozzle, as indicated by the numeral 83. The outer periphery of the plate 80 is fixedly secured to the liner 81 by any suitable means, as by suitable screws 76.

The mounting bracket 67 is fixedly secured to the inlet nozzle 11 by any suitable means, as by a plurality of support rods which are each generally indicated by the numeral 84. As shown in FIG. 2, the support rods 84 would be disposed around the periphery of the combustion devices, and in one embodiment, at least three such support rods 84 were employed. As shown in FIG. 2, one end 85 of each support rod 84 is mounted in a suitable opening 89 in the lower end of the mounting bracket 67. The support rod is then bent outwardly and around the lower end of the preheater nozzle 76, and then upwardly and back down through the nozzle, and then through an opening 90 in the bracket 67 adjacent the opening 89. The aforementioned end 85 of each support rod 84 abuts the rod portion 87 and as indicated by the numeral 86, it extends downwardly through an opening 90 through the bracket 67. The lower ends 87 of the support rods 89 are each fixedly mounted in bores 91 in equally spaced apart annularly disposed bores 91. The rods 84 would be fixedly secured to the mounting bracket 67 by any suitable means. The end of the rod portion 87 attached to the inlet nozzle 11 will also be fixedly secured to the inlet nozzle 11 by any suitable means, as by welding. As shown in FIG. 2, each of the support rods 84 carries support brackets 88 which hold the fuel preheater tubes 53, 54 and 55 in vertically spaced apart positions.

As shown in FIGS. 1 and 2, the support plate 80 is provided with an opening 92 for admittance of a pilot flame into the area within the preheater nozzle 76. A flame guide bracket 93 is attached by any suitable means, as by welding, to the lower tube 53 and it extends up through the opening 92 for guiding the pilot flame into the area within the preheater nozzle 76. A horizontal mounting plate 94 is integrally attached to the lower end of the plate 93 and it carries a mounting bracket 95 which operatively supports a pilot fuel feed tube 96. The pilot fuel feed tube 96 has its upper end fixedly secured by any suitable means to a mounting plate 97 which is fixed by any suitable means, as by welding, to the mounting bracket 95. The upper end of the pilot fuel tube 96 is spaced downwardly from the plate 94 and the opening 92. Operatively mounted in the upper end of the pilot fuel tube 96 is a conventional pilot nozzle orifice 98. The lower end of the pilot fuel tube 96 is provided with a pilot fuel orifice 99 (FIG. 11) and holes 100 to entrain air for mixture with the fuel being fed through the tube 96. The lower end of the tube 96 would be connected to a suitable source of pilot fuel under pressure.

In use, the fuel supply throttling valve 58 is connected to a suitable source of liquid fuel under pressure, and a pilot fuel supply under pressure is connected to the pilot fuel orifice 99 in the fuel tube 96. The fuel under pressure is forced through the filter 57 and up through the fuel line 56 through the preheater 18 to vaporize the fuel, from whence the fuel passes downwardly through the line 52 and into the passage 48. The fuel under pressure is expanded by expulsion through the circumferential slot or gap formed between the peripheral edge 44 and the converging primary nozzle surface 42. The last mentioned action creates a boundary layer blowing in effect which creates a negative pressure at the intake throat area of the inlet nozzle, thereby entraining air for combustion. The air-fuel mixture is given a thorough mixing as the mixture is driven through the two-section thrust-augmenter diffuser 12. The air-fuel mixture hugs the walls of the two stages 13 and 14 of the diffuser 12 as it flows through the diffuser 12. The air-fuel mixture is expelled through the flame-arrestor screen 15, and exterior burning commences in the regenerative nozzle type preheater means 76. The flame then exits to the atmosphere for operative purposes.

The size of the annular slot or gap $G_p$ formed around the peripheral edge 44 is set for each embodiment, but said gap can be adjusted when the combustion device is assembled by adjusting the spacing between the two inlet device body parts 23 and 24 with suitable shims or the like.

Throughout the range of useful output, a stable flame front remains attached to the exit surface of the flame-arrestor screen 15 due to the random pore size of the screen 15. The result is to provide flame retention and suppress sound pressure levels normally generated by open air flame fronts. The unique arrangement of screen to diffuser components, is accomplished with minimum pressure drop or generated back pressure loss so as to make practical the efficient operation of the inlet nozzle 11.

It will be understood that the inlet nozzle 11 employs the well known "COANDA" (a trademark) effect or "Coanda" wall jet blowing of the vaporized fuel. The inlet nozzle of the combustion device of the present invention, while resembling a known type of device referred to in the prior art as a thrust-augmenter ejector, a "COANDA" nozzle, or a "TRANSVECTOR" (a trademark), is constructed and arranged to produce a maximum possible secondary air entrainment for dense driving fluids, such as propane. It has been found that the effective primary nozzle area $A_o$, which is the area of the annular primary nozzle area between the peripheral edge 44 and the converging wall portion 42, should be reduced 20%–30% over such gaps as normally used in prior art air driven devices so as to produce the maximum secondary air entrainment. The pressure equalization gap between the inlet nozzle surfaces 40 and 41, which circumferentially distributes preheated fuel to the primary nozzle, should be reduced by the same proportion 20%–30%. The operating temperature of the working fuel fluid under pressure, and also the density, is limited to less than +380° F. to prevent carbonization of the fuel at the pressure equalization gap between the inlet nozzle surfaces 40 and 41. A lower temperature limit of +120° F. is ideal to discourage the formation or collection of waxes, oils, or gels resulting from the cracking process of preheat, acceleration at said pressure equalization gap, and deceleration and cooling at the primary nozzle exit point $A_o$. Such oil formation collects at the surface "L" of the mix-zone, as well as at said pressure equalization gap, but it is almost totally eliminated by such temperature control. Filtering the driving fuel fluid by conventional means to a mean particle diameter less than one third the width of said pressure equalization gap prevents clogging. The inlet nozzle of the present invention is also constructed and arranged different from the aforementioned prior art devices by decreasing the angle of divergence of the diffuser first section 13 by 2°–3° over the diffuser angles found in similar air driven inlet nozzles in order to allow for the increased density of the driving gas. The aforementioned prior art devices employ an included angle of divergence in the diffusor first section of 13° to 15°, and the first section 13 of the diffuser 12 of the present invention employs an included angle of 10° to 12°. The last mentioned means of density correction is to allow the mix zone area from $A_1$ to $A_2$ ("L") to pass a constant weight of mixture.

The length "L" of the mix zone is determined by the ratio of the areas $A_3/A_2$ of the diffuser 12. Experience has shown that an optimum length for "L" is 0.4" for a diffuser having a ratio of areas $A_3/A_2=3.6$ in the first section, and a ratio of $A_4/A_3=3.6$ in the second section of the diffuser. These proportions are for an inlet nozzle with a ratio of primary nozzle area $A_o$, to throat area $A_1$equal to 45. This last mentioned value of ratio values $A_o$ to $A_1$ may be designated "S." The value of "S" is found to represent an optimum value for inlet nozzles driven by propane, while maintaining burning exterior to the screen 15 when using the aforedescribed diffuser combination of the present invention.

An optimum operative range of "S" found for combustion devices of the present invention range from S=10 to S=50. The desired pressure ratio (PR) range, that is the ratio of total pressure at point $G_p$ to atmospheric pressure, for the last mentioned range of "S," has been found to extend from 1.14 to 2.18. For example, at "S"=45, the optimum pressure ratio (PR) is 1.5.

The unique two-section diffuser 12 of the present invention minimizes back pressure created by the flame-arrestor screen 15. A screen 15 producing a pressure drop factor less than 0.4 (40%) will not adversely affect the performance of the inlet nozzle 11 if a suitable flame stop ability is also present because of the screen 15. The area ratios for each diffuser section increase in proportion to the pressure drop factor for a given screen 15 in order to provide the same effective area at the diffuser exit. A diffuser formed by an included angle of from 10° to 12° in the first section 13, and an included angle of 75° to 80° in the second section 14, is found to be the most effective arrangement for the aforementioned "S" range.

The entrainment ratio of secondary air is a direct indication of thrust augmentation ($\phi$), and the two-section diffuser 12 of the present invention functions as a thrust amplifier which conserves the angle of diffusion in each section, but which extends each section to reach values of $A_3/A_2$ and $A_4/A_3$ which are 40% greater than ratios which are used in prior art open exit diffusers for optimum "$\phi$."

The flame-arrestor screen 15 is selected from conductive high temperature metals such as aluminum, copper, nickel, silver, gold or platinum or certain stainless steel alloys, or plated or composite variations of these metals on each other or ceramic substrates. A suitable porous open celled nickel material for use in making the flame-arrestor screen 15 is a material available on the market under the trademark "FOAMETAL." A screen made from the last mentioned material produces a minimum pressure drop for the most open pored material which could positively affect a flame stop at all fuel pressures with as great a density (intercellular metal wall thickness) as is possible with a pressure drop factor of less than 0.4. It was found that a screen 15 having the greatest output range is one having a ten pore per inch, 5%–7% density, nickel screen of "FOAMETAL" measuring ¼" in thickness. The intake air filter 19 may be made from a suitable wire knit mesh screen or other suitable material. A metal of high thermal conductivity is best suited to accomplish the functions of filtering and flame arresting with the lowest pressure drop. A suitable nicket-chrome metal is "INCONEL" (a trademark). The retainer ring member 28 is composed of the same knit mesh (metal wire) as the intake filter 19, but it may be made of other resilient heat resisting materials. The support ring 79, support plate 80, bracket 67 and liner 81 may each be made of a heat resisting metal or other suitable material such as a ceramic material.

Combustion is maintained commencing at the surface of the screen 15 throughout the pressure ratio (PR) range limits of useful operation. The screen 15 must be of sufficient thickness and density for a given design to limit the interior screen surface to a temperature less than 800° F. at the lowest possible fuel pressures.

The regenerative nozzle preheater 76 is disposed at the exit of the screen 15, and it is constructed to create as closely as possible an equal temperature supply of vaporized fuel over the useful pressure ratio range. The preheater nozzle 76 aids the operation of the combustion device of the present invention by eliminating or reducing the free jet curvature of the exiting stream, which impedes the inlet nozzle performance with large exit angle diffusers.

Throttling the combustion device 10 of the present invention is accomplished by varying the fuel pressure from 10–165 psi, to cause the combustion device to operate in the optimum pressure ratio (PR) range. Throughout this range, the combustion device of the present invention entrains a nearly proportional amount of secondary air per unit of driving gas.

While it will be apparent that the preferred embodiment of the present invention herein disclosed is well calculated to achieve the results aforestated, it will be appreciated that the invention is susceptible to modification, variation and change.

What is claimed is:

1. A combustion device for use with pressurized and zero pressure hot air appliances comprising:

(a) a fuel driven Coanda-type inlet nozzle including a primary nozzle having an inwardly converging wall portion which has an entrance end and an exit end;

(b) said inlet nozzle further including an annular fuel exit gap around the entrance end thereof, with said converging wall portion forming an outer annular boundary wall for said exit gap;

(c) a fuel supply means operatively connected to said inlet nozzle fuel exit gap for supplying fuel under pressure to said inlet nozzle;

(d) a diffuser having an exit end, and an entrance end operatively mounted on the exit end of said inlet nozzle;

(e) mounting bracket means secured to the diffuser at the exit end thereof;

(f) an annular flame-arrestor screen mounted in said diffuser at the exit end thereof:

(g) releasable attachment means for securing the flame-arrestor screen to said diffuser and said mounting bracket means;

(h) said fuel supply means including a preheater nozzle, and a fuel preheater means comprising a heat exchange coil;

(i) said fuel preheater means and preheater nozzle means being operatively mounted around the exit end of said diffuser;

(j) support bracket and rod means for mounting the fuel preheater means heat exchange coil around the exit end of said diffuser in a position spaced longitudinally and radially outward from the annular flame-arrestor screen;

(k) means for mounting said preheater nozzle means on said mounting bracket means, in a position around the outer side of said heat exchange coil and in a position spaced therefrom;

(l) said preheater nozzle means comprising a cylindrical tubular body which is covered on the inner face thereof by a liner having an outwardly curved exit end;

(m) a circular support ring mounted around the exit end of said diffuser and being secured to said mounting bracket means and having an integral, annular, arcuate inner peripheral portion which seats against the outer peripheral edge of the flame-arrestor screen and with the arcuate portion extending toward the exterior of the diffuser; and, (n) whereby the expansion of fuel under pressure through said annular fuel exit gap around the primary nozzle inwardly converging wall portion forms a Coanda wall jet blowing of vaporized fuel around said primary nozzle converging wall portion for the induction of air down the center of the nozzle to maintain an attachment of the flow of vaporized fuel to the diffuser wall throughout the length thereof and produce a high entrainment ratio of air, and to maintain a fuel lean center flow of fuel and air to prevent a radiant flame form at, and directly above, the center of the flame-arrestor screen, so that said flows of mixed air and fuel are carried through the diffuser and through the flame-arrestor screen, and are ignited and burned exterior of the diffuser with the arcuate support ring functioning to direct the pattern of the flame radially outward into heat exchange relationship with the heat exchange coil, and said preheater nozzle liner functions as a flame stabilizer nozzle.

2. A combustion device as defined in claim 1, wherein:

(a) said diffuser is a two-section diffuser having two successive diverging sections including a first section having an entrance end.

3. A combustion device as defined in claim 2, wherein:

(a) said inlet nozzle includes a constant diameter intake throat, and said primary nozzle includes an annular pressure equalization passageway disposed around said intake throat and communicating with said exit gap.

4. A combustion device as defined in claim 3, wherein:

(a) said inlet nozzle includes a fuel-air mix zone having an inlet end adjacent said primary nozzle and an exit end adjacent the entrance end of the first section of said diffuser.

5. A combustion device as defined in claim 4, including:

(a) a pilot ignition means operatively mounted on said combustion device adjacent the exterior surface of said flame arrestor screen for igniting the fuel-air mixture exterior of the flame arrestor screen.

* * * * *

UNITED STATES PATENT OFFICE

CERTIFICATE OF CORRECTION

Patent No. 4,332,547 Dated June 1, 1982

Inventor(s) James D. MacDonald, Jr.

It is certified that error appears in the above-identified patent and that said Letters Patent are hereby corrected as shown below:

Column 1, line 20 - "device" should be --devices--

Column 2, line 55 - "this" should be --the--

Column 3, line 2 - after "combustion", insert --device--

Column 5, line 37 - "devices" should be --device--

Column 6, line 42 - "device" should be --nozzle--

Signed and Sealed this

Tenth Day of August 1982

[SEAL]

Attest:

GERALD J. MOSSINGHOFF

Attesting Officer

Commissioner of Patents and Trademarks